United States Patent [19]

Strong

[11] Patent Number: 5,020,579

[45] Date of Patent: Jun. 4, 1991

[54] AUTOMATIC INFEED CONTROL

[75] Inventor: Donald E. Strong, Remus, Mich.

[73] Assignee: Strong Manufacturing, Remus, Mich.

[21] Appl. No.: 527,124

[22] Filed: May 21, 1990

[51] Int. Cl.[5] ..... B27C 1/12; B02C 18/16

[52] U.S. Cl. ..... 144/176; 144/246 F; 144/246 G; 144/249 A; 144/356; 198/624; 241/101.7

[58] Field of Search ..... 241/55, 101.7; 144/162 R, 176, 246 R, 246 E, 246 F, 246 G, 249 R, 249 A, 356, 357; 198/624

[56] References Cited

U.S. PATENT DOCUMENTS

| | | | |
|---|---|---|---|
| 2,679,873 | 6/1954 | Hill . | |
| 3,000,411 | 9/1961 | Ealet . | |
| 3,032,281 | 5/1962 | Wexell . | |
| 3,276,700 | 10/1966 | Eklund . | |
| 3,384,311 | 5/1968 | Eklund et al. . | |
| 3,524,485 | 8/1970 | Smith . | |
| 3,635,410 | 1/1972 | Smith . | |
| 3,844,489 | 10/1974 | Strong . | |
| 4,057,192 | 11/1977 | Smith | 144/176 |
| 4,073,377 | 2/1978 | Stoessel et al. | 198/624 |
| 4,078,590 | 3/1978 | Smith | 241/101.7 |
| 4,160,471 | 7/1979 | Lapointe | 144/176 |
| 4,390,132 | 6/1983 | Hutson et al. | 241/101.7 |
| 4,510,981 | 4/1985 | Biller | 198/624 |
| 4,719,950 | 1/1988 | Peterson et al. . | |
| 4,889,169 | 12/1989 | Peterson et al. | 144/176 |

*Primary Examiner*—W. Donald Bray
*Attorney, Agent, or Firm*—Price, Heneveld Cooper DeWitt & Litton

[57] ABSTRACT

In a wood chipping machine, having a powered infeed material conveyor, an infeed control circuit for automatically adjusting infeed material capacity. The circuit has a monitor for monitoring infeed conveyor loading and a switch which is responsive to the monitor such that the infeed capacity is adjusted to accommodate large material when the conveyor loading reaches a predetermined level.

18 Claims, 2 Drawing Sheets

AUTOMATIC INFEED CONTROL

BACKGROUND OF THE INVENTION

The present invention generally relates to wood chippers and specifically relates to controls for wood chipper infeed conveyor systems, as are typically found on large wood chipping machines.

Wood chippers are large, heavy machines and are commonly built with an integrated trailer towing frame for portability to a job site. An infeed chute with a powered conveyor is often used to feed wood stock, typically a tree, into the chipper. These infeed conveyors typically use chains, rollers or combinations of both to feed the material into the front side of a cutter disk. The cutter disk is commonly a thick, circular metal plate with at least a pair of cutter knives which are mounted adjacent chip slots, formed in the disk. The disk is rotatably mounted in a cylindrical chamber and rotated at a relatively high speed by a motor, also commonly mounted on the integrated frame. The disk is often set at an acute angle to the direction of feed such that the knives tend to draw the material into the disk. As the material is feed into the front side of the disk, the knives continuously slice the end of the material to form chips which pass through the chip slots to the back of the disk. The chips are removed from the back of the disk in part by centripetal force and in part by an air flow which is induced by fan blades, commonly mounted on the back of the disk. A chip discharge chute extends tangentially from the disk housing and the air flow from the fan blades carries the chips out of the housing and through the chute for discharge from the chipper.

The conveyor system will often have at least a lower powered rollers rotatably mounted to the infeed chute frame and rotating at a predetermined speed for controlled infeed of material into the cutter disk. An upper powered infeed roller is also provided such that material is captured between the upper and lower rollers for positive feed of the material without slippage. A wide range of material sizes can be feed into the chipper and is usually accommodated by a floating upper roller, rotatably mounted on a pivotable carrier. A double acting hydraulic ram is commonly connected between the chute frame and the pivotable upper roller carrier for pulling the upper roller down towards the lower rollers to grab material between the upper and lower rollers or for lifting the upper roller away from the lower rollers to accommodate large material or to clear a material jam. Usually, the hydraulic ram is manually controlled for lifting the upper feed roller or pulling it down. In the normal float mode, the upper feed roller will roll on top of small to medium sized materials. However, when large materials are fed in, the upper feed roller can jam and stop turning. As is currently customary when an infeed jam occurs, an operator who monitors the infeed of material, actuates a manual control to lift the upper feed roller and clear the jam.

A wood chipper is often used in a contemporary wood chip processing operation by placing it between a debarking apparatus and a chip receptacle. Trees are dragged out of the forest to the operation cite where a small crane apparatus feeds the trees through the debarker and into the chipper. The chipper conveyor system receives the trees out of the debarker apparatus and feeds them into the chipper disk where they are cut into chips and the chips are discharged into the receptacle. While one operator is required for operating the crane device to feed trees through the debarker and into the chipper, a second operator is required to monitor the infeed of trees into the chipper and to manually lift the upper infeed roller to accommodate large trees or to clear infeed jams. This second operator is not otherwise required for the safe and effective operation of the wood chip production site.

SUMMARY OF THE INVENTION

The present invention eliminates the need for an extra operator to monitor the wood chipper infeed conveyor for jamming and to manually actuate a switch for raising the upper infeed conveyor roller by providing an automatic infeed control circuit which automatically monitors the loading of the infeed conveyor and actuates the hydraulic ram to lift the upper conveyor roller, accommodate large material and clear a jam.

In one aspect of the invention, the infeed control circuit of the invention includes a sensor which is responsive to the loading condition of the infeed conveyor for generating a signal when the infeed conveyor loading reaches a predetermined level, indicating a jammed condition. In another aspect of the invention, a hydraulic control valve which is responsive to the signal generated by the sensor is provided in the hydraulic circuit for the hydraulic ram to actuate the ram and lift the upper powered roller. These and other features, objects and advantages of the present invention will become apparent upon reading the following description thereof in connection with the accompanying drawings in which:

DESCRIPTION OF THE PREFERRED EMBODIMENT

Figure 1:
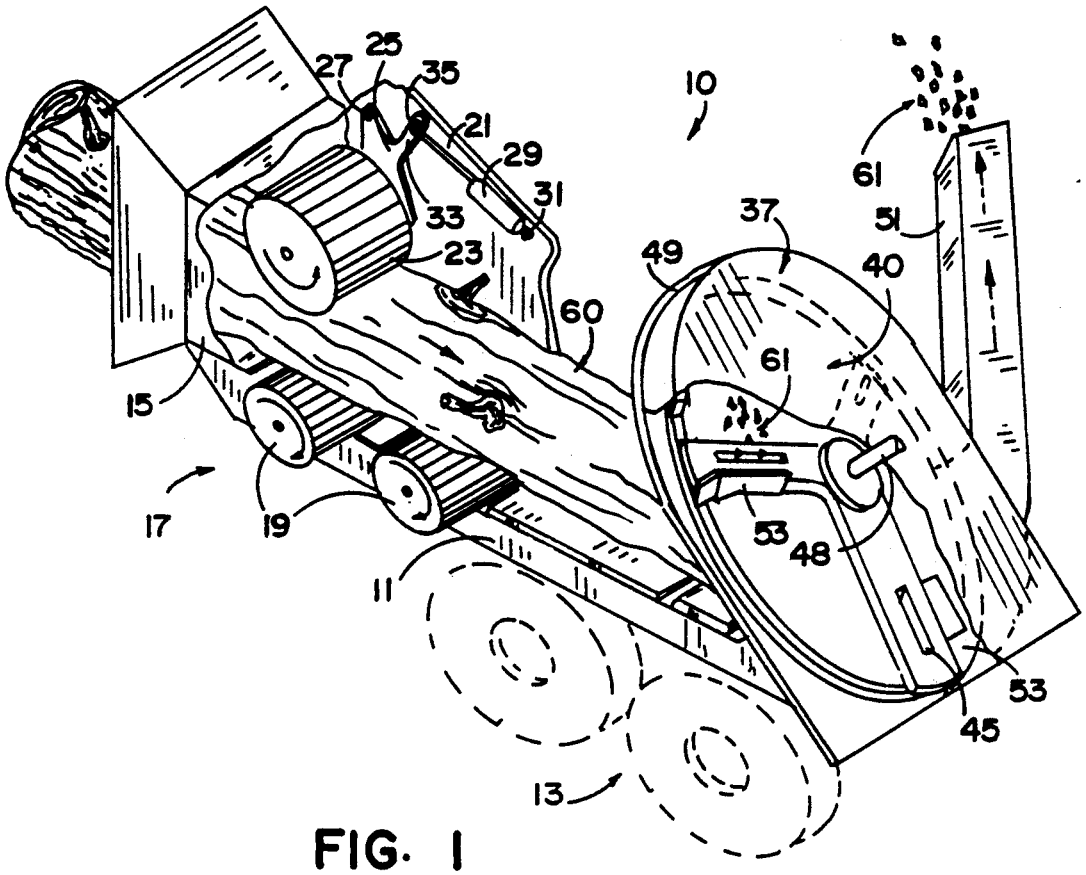
FIG. 1 is a fragmentary perspective view of a portion of a wood chipping machine embodying the present invention.
Figure 2:
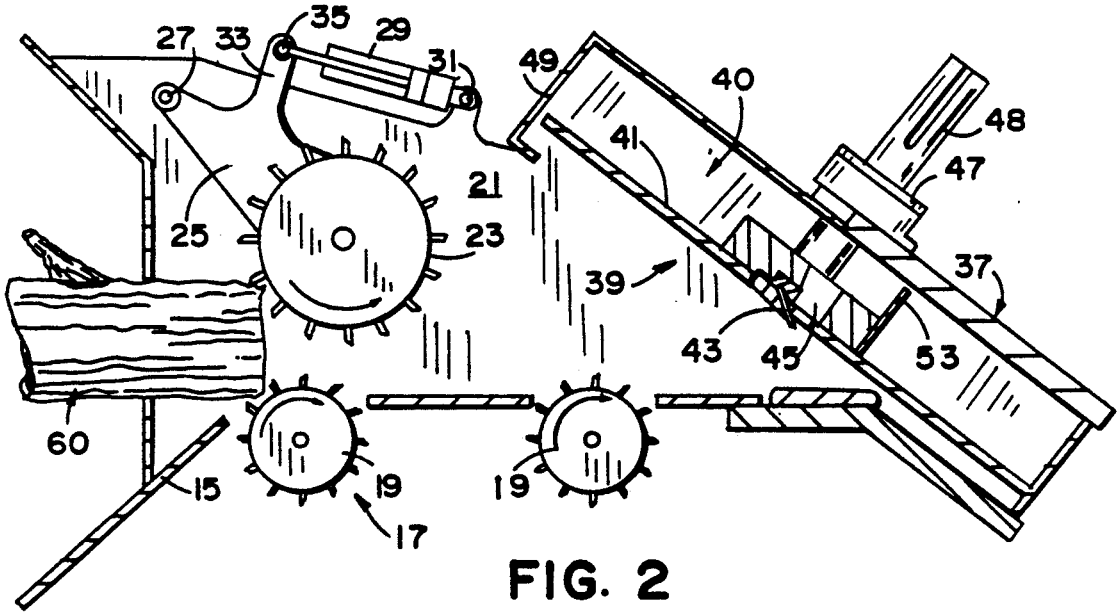
FIG. 2 is a longitudinal section view of the machine of FIG. 1 taken along plane II—II.

Referring initially to FIGS. 1 and 2, a wood chipper 10, embodying the present invention, is shown integrally constructed on a towing frame 11 including an axle, wheel and suspension assembly 13 for portability to a job site. Chipper 10 includes an infeed chute 15 and a powered material conveyor 17 for feeding material, typically a tree 60, into chipper 10. Conveyor 17 includes a pair of spaced lower rollers 19 which are rotatably mounted to infeed chute housing 21 and are powered to carry tree 60 into chipper 10. Conveyor 17 also includes a powered upper roller 23 which is rotatably mounted to a carrier 25 which in turn is pivotally mounted at a pivot axle 27 to infeed chute housing 21 for lifting and lowering roller 23 substantially vertically, away from and toward rollers 19, to accommodate different sizes of trees.

Carrier 25 is actuated by an automatically and manually controlled, double acting hydraulic ram 29 having one end pivotally mounted to housing 21 at a pivot axle 31 and an opposite end pivotally connected to actuating arm 33 of carrier 25 at a pivot axle 35. Ram 29 is normally in a float mode allowing roller 23 to float upon tree 60, engaging the tree between rollers 19 and 23. However, ram 29 can be manually actuated to pull roller 23 down towards rollers 19 to firmly grasp tree 60 between the infeed rollers. Conversely, ram 29 is automatically actuated to lift roller 23 to increase material capacity, accommodating large trees, and to clear material jams. Ram 29 can also be actuated manually to lift roller 23. The conveyor 17 feeds tree 60 into a cutter housing 37 through an infeed opening 39 to the front side of a cutter disk assembly 40.

The cutter disk assembly 40 includes a thick metal disk 41 with three equally spaced knives 43. Knives 43 are conventionally mounted at an angle to the edge of chip slots 45, formed through disk 41. Cutter disk assembly 40 is rotatably mounted to housing 37 by a suitable bearing assembly 47 and power is supplied to a shaft 48 of the disk assembly for rotating the disk at relatively high speed. Housing 37 defines a generally cylindrical chamber with curved side walls 49 and a tangential discharge chute 51. Disk assembly 40 is mounted at an acute angle to the direction of feed, such that knives 43 tend to draw tree 60 into disk assembly 40. As tree 60 is feed into the front side of disk assembly 40, knives 43 slice the end of the tree to form chips 61 which pass through chip slots 45 to the back of disk assembly 40. Chips 61 move radially to the perimeter of disk assembly 40 in part by centripetal force and in part by an air flow, induced by conventional fan blades 53 which are attached to the back of disk assembly 40. The air flow induced by fan blades 53 also carries the chips to the perimeter of housing 37 and through chip chute 51 for discharge from chipper 10.

Figure 3:
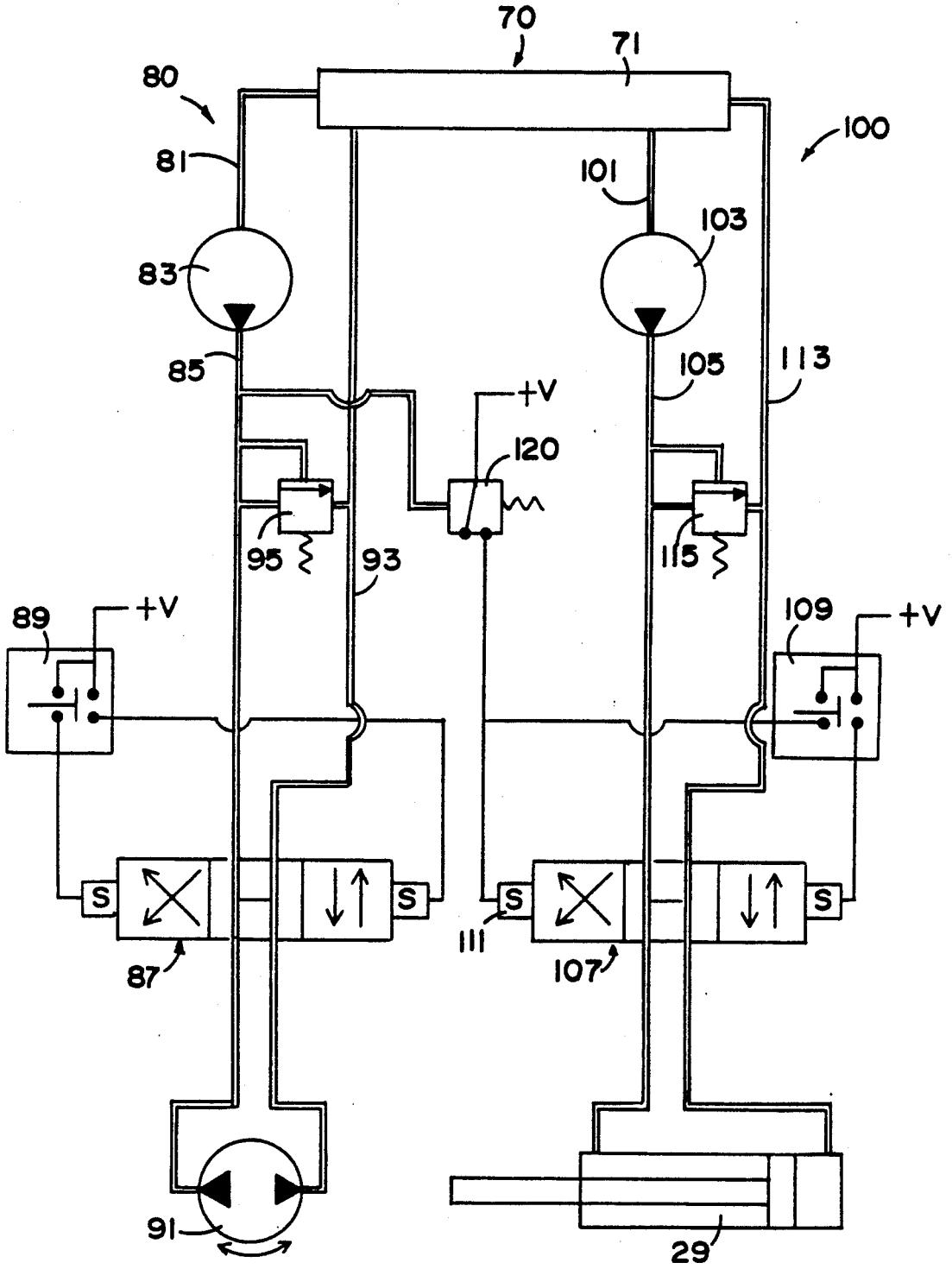
FIG. 3 is an electrical & fluid flow diagram in schematic form of the hydroelectric control system for the infeed conveyor of the present invention.

Material conveyor 17 includes rollers 19 and 23 and ram 29, powered by a hydraulic power system 70 as schematically shown in FIG. 3. System 70 has an infeed conveyor drive circuit 80 and a hydraulic ram circuit 100 which share a common hydraulic fluid reservoir 71.

In drive circuit 80, fluid is drawn from reservoir 71 through a supply line 81 by a hydraulic pump 83 which pumps the fluid through a second supply line 85 to a solenoid actuated hydraulic control valve 87 which is electrically actuated by a control switch 89. Switch 89 is a two pole, double throw electric switch having both terminals on one side jumpered together and connected to a conventional electrical power source +V. The other side of switch 89 has a first terminal connected to a first terminal on valve 87 for actuating conveyor 17 in the normal infeed mode and a second terminal connected to a second terminal on valve 87 for actuating conveyor 17 in a reverse mode. Switch 89 is shown in a neutral position in FIG. 3 such that conveyor 17 is not driven. A hydraulic motor 91 for powering infeed conveyor 17 is connected to hydraulic control valve 87 which controls the power and direction of motor 91 by metering the pressure and direction of flow of fluid to the motor as directed by switch 89, described above. Hydraulic fluid is returned from valve 87 to reservoir 71 via a return line 93. A pressure relief valve 95 is connected between supply line 85 and return line 93 for limiting the maximum operating pressure to approximately 3500 p.s.i. in circuit 80 by diverting fluid from supply line 85 to reservoir 71, through return line 93, if a predetermined pressure limit is attained in line 85.

In ram control circuit 100, fluid is drawn from reservoir 71 through a supply line 101 by a hydraulic pump 103 which pumps the fluid through a second supply line 105 to a solenoid actuated hydraulic control valve 107 which is electrically actuated by a control switch 109. Switch 109 is a two pole, double throw electric switch having both terminals on one side jumpered together and connected to a conventional electrical power source +V. The other side of switch 109 has a first terminal connected to a first terminal on hydraulic control valve 107 for actuating ram 29 to pull upper roller 23 down toward lower rollers 19, firmly grasping tree 60 between the infeed rollers, and a second terminal connected to a second terminal 111 on valve 87 for actuating ram 29 to lift upper roller 23 up away from lower rollers 19, increasing material capacity, accommodating large trees and clearing material jams. Switch 109 is shown in a neutral position in FIG. 3 such that ram 29 is in a float mode, allowing roller 23 to float upon tree 60 and engage the tree between rollers 19 and 23. Double acting hydraulic ram 29 is connected to hydraulic control valve 107 which controls the power and direction of movement of ram 19 by metering the pressure and direction of flow of fluid to the ram as directed by switch 109, described above. Hydraulic fluid is returned from valve 107 to reservoir 71 via a return line 113. A pressure relief valve 115 is connected between supply line 105 and return line 113 for limiting the maximum operating pressure in circuit 100 by diverting fluid from supply line 105 to reservoir 71, through return line 113, if a predetermined pressure limit is attained in line 105.

A hydroelectric pressure sensing switch 120 is connected to supply line 85 of drive circuit 80 and between a conventional electric power source +V and terminal 111 on valve 107 of ram circuit 100. The pressure of the hydraulic fluid is directly related to the power required by conveyor 17 and pressure switch 120 is selected to respond to a predetermined pressure level of approximately 3400 p.s.i. in line 85, indicating that the conveyor requires more power, that hydraulic motor 91 is stalling and that conveyor 17 is jamming. When the predetermined pressure is reached, switch 120 closes to supply an electric current from source +V to terminal 111 of valve 107, actuating the valve to cause ram 29 to pivot carrier 25 about pivot axle 27 and lift upper roller 23 away from lower rollers 19, increasing the infeed capacity of conveyor 17 and clearing the jam. As soon as the jam clears, the pressure in line 85 drops, switch 120 opens and ram 29 returns to the normal float mode.

While a hydroelectric pressure sensing switch 120 is employed in the preferred embodiment, other sensing means for providing a control signal in the event of an infeed jam can also be employed. Such sensing means might include such simple means as a hydraulic pressure feedback line to actuate control valve 107 or such sophisticated means as a laser device for sensing tree size to actuate the control valve, for example. While the preferred embodiment specifically applies to a hydraulic conveyor infeed system for a wood chipper, the present invention can also be applied to such systems which are electrically or mechanically driven. Various modifications of the preferred embodiment of the invention will occur to those skilled in the art and will fall within the scope and spirit of this invention as defined by the appended claims.

The embodiments of the invention in which an exclusive property or privilege is claimed are defined as follows:

1. In a wood chipper with an infeed conveyor, said conveyor having a drive system for powering and controlling said conveyor, an infeed control system comprising: adjustment means for increasing infeed material capacity, an operating system for operating said adjustment means and a sensor responsive to the movement of wood on said conveyor for actuating said adjustment means to prevent stalling of said conveyor.

2. The infeed control system as defined in claim 1 wherein said sensing means is responsive to the power level required by said conveyor and generates said signal at a predetermined power level.

3. The infeed control system as defined in claim 2 wherein said drive system is a hydraulic power system, including a hydraulic pump and a hydraulic motor, and said sensing means senses the hydraulic drive fluid pressure between said pump and said motor.

4. The infeed control system as defined in claim 3 wherein said adjusting means is a floating infeed roller and said roller is rotatably mounted to a pivotable carrier.

5. The infeed control system as defined in claim 4 wherein said adjustment means further includes a hydraulic ram for positioning said carrier and a hydraulic power system, including a hydraulic control valve, for positioning said ram and said actuating means actuates said control valve, causing said ram to position said carrier such that said infeed capacity increases.

6. The infeed control system as defined in claim 5 wherein said sensing means is responsive to the power level required by said conveyor and generates said signal at a predetermined power level and wherein said adjusting means is a floating infeed roller and said roller is rotatably mounted to a pivotable carrier.

7. In a wood chipping machine having an infeed conveyor, said conveyor having a drive system for powering and controlling said conveyor, and having adjustment means for adjusting said conveyor infeed capacity to accommodate different sizes of infeed material, said adjustment means having an operating system: an infeed control circuit comprising a sensing means responsive to the loading condition of said conveyor for generating a signal and an actuating means responsive to said signal for actuating said operating system to increase said infeed capacity.

8. The infeed control system as defined in claim 7 wherein said sensing means is responsive to the power level required by said conveyor and generates said signal at a predetermined power level.

9. The infeed control system as defined in claim 8 wherein said drive system is a hydraulic power system, including a hydraulic pump and a hydraulic motor, and said sensing means senses the hydraulic drive fluid pressure between said pump and said motor.

10. The infeed control system as defined in claim 9 wherein said adjusting means is a floating infeed roller and said roller is rotatably mounted to a pivotable carrier.

11. The infeed control system as defined in claim 10 wherein said adjustment means further includes a hydraulic ram for positioning said carrier and a hydraulic power system, including a hydraulic control valve, for positioning said ram and said actuating means actuates said control valve, causing said ram to position said carrier such that said infeed capacity increases.

12. The infeed control system as defined in claim 7 wherein said sensing means is responsive to the power level required by said conveyor and generates said signal at a predetermined power level and wherein said adjusting means is a floating infeed roller and said roller is rotatably mounted to a pivotable carrier.

13. In a wood chipper with an infeed conveyor, said conveyor having a drive system for powering and controlling said conveyor, an infeed control system comprising: adjustment means for increasing infeed material capacity, an operating system for operating said adjustment means and a sensor responsive to the loading of said conveyor for actuating said adjustment means to prevent stalling of said conveyor.

14. The infeed control system as defined in claim 13 wherein said sensing means is responsive to the power level required by said conveyor and generates said signal at a predetermined power level.

15. The infeed control system as defined in claim 14 wherein said drive system is a hydraulic power system, including a hydraulic pump and a hydraulic motor, and said sensing means senses the hydraulic drive fluid pressure between said pump and said motor.

16. The infeed control system as defined in claim 15 wherein said adjusting means is a floating infeed roller and said roller is rotatably mounted to a pivotable carrier.

17. The infeed control system as defined in claim 16 wherein said adjustment means further includes a hydraulic ram for positioning said carrier and a hydraulic power system, including a hydraulic control valve, for positioning said ram and said actuating means actuates said control valve, causing said ram to position said carrier such that said infeed capacity increases.

18. The infeed control system as defined in claim 13 wherein said sensing means is responsive to the power level required by said conveyor and generates said signal at a predetermined power level and wherein said adjusting means is a floating infeed roller and said roller is rotatably mounted to a pivotable carrier.

* * * * *